US006220181B1

(12) United States Patent
Horski

(10) Patent No.: US 6,220,181 B1
(45) Date of Patent: Apr. 24, 2001

(54) ERGONOMIC CAD (COMPUTER AIDED DESIGN) WORKSTATION

(76) Inventor: Marek Horski, 469 Emery St. East, London, Ontario (CA), N6C 2E9

( * ) Notice: Subject to any disclaimer, the term of this patent is extended or adjusted under 35 U.S.C. 154(b) by 0 days.

(21) Appl. No.: 09/422,780

(22) Filed: Oct. 21, 1999

(51) Int. Cl.[7] ..... A47B 21/03

(52) U.S. Cl. ..... 108/50.01; 108/138; 312/223.2; 248/276.1

(58) Field of Search ..... 108/50.01, 65, 108/138, 50.02, 93, 96; 312/223.3, 234, 208.1; 248/286.1, 276.1

(56) References Cited

U.S. PATENT DOCUMENTS

| | | | | |
|---|---|---|---|---|
| D. 140,501 | | 3/1945 | Fletcher . | |
| D. 214,632 | | 7/1969 | Leprince . | |
| D. 252,635 | | 8/1979 | Richgels . | |
| D. 266,714 | | 11/1982 | Crespi . | |
| D. 267,988 | | 2/1983 | Crespi . | |
| D. 281,294 | | 11/1985 | Hoppe . | |
| D. 282,422 | | 2/1986 | Uellenberg et al. . | |
| D. 302,085 | | 7/1989 | Tingley . | |
| D. 305,706 | | 1/1990 | Mark . | |
| 734,817 | | 7/1903 | Cavanaugh et al. . | |
| 744,888 | | 11/1903 | Widman et al. . | |
| 3,506,323 | | 4/1970 | Leprince . | |
| 3,588,210 | | 6/1971 | DesMarais . | |
| 3,869,992 | | 3/1975 | Kramer . | |
| 3,922,045 | | 11/1975 | Meyer . | |
| 4,561,619 | | 12/1985 | Robillard et al. . | |
| 4,815,392 | * | 3/1989 | Soot | 108/65 |
| 4,927,214 | | 5/1990 | Kaufman et al. . | |
| 5,092,253 | | 3/1992 | Grund et al. . | |
| 5,522,323 | * | 6/1996 | Richard | 108/50.01 X |
| 5,680,820 | * | 10/1997 | Randolph | 312/223.3 X |
| 5,704,299 | * | 1/1998 | Corpuz, Jr. et al. | 108/50.01 X |
| 5,857,415 | * | 1/1999 | Richard | 108/50.01 |
| 5,947,034 | * | 9/1999 | Belka et al. | 108/50.01 |
| 5,961,192 | * | 10/1999 | Bernart et al. | 312/223.3 |
| 6,119,994 | * | 9/2000 | Price | 108/138 X |

* cited by examiner

*Primary Examiner*—Jose V. Chen
*Assistant Examiner*—Michael J. Fisher
(74) *Attorney, Agent, or Firm*—George L. Boller

(57) ABSTRACT

A computer workstation stand has a platform having a generally horizontal support surface large enough to support a monitor. A table is disposed frontally of the platform and has a flat support surface with a center expanse large enough to support a computer keyboard and wings extending from laterally opposite sides of the center expanse that are themselves sufficiently expansive to support auxiliary computer equipment that requires manual manipulation by a user while allowing a user who is situated frontally of the table and facing a monitor supported on the horizontal support surface of the platform to rest his or her forearms on the wings while manipulating auxiliary equipment supported on the wings. A mechanism operatively relates the table to the platform to allow the table to be positioned in a desired spatial relationship to the platform. Specifically the mechanism allows the table to be tilted and elevated.

11 Claims, 7 Drawing Sheets

ERGONOMIC CAD (COMPUTER AIDED DESIGN) WORKSTATION

BACKGROUND OF THE INVENTION

FIELD OF THE INVENTION

This invention relates generally to computer workstations, and especially to a workstation for computer aided design.

BACKGROUND AND SUMMARY OF THE INVENTION

A preliminary novelty search in connection within this invention developed various U.S. Patents that are identified on an attachment to an accompanying Information Disclosure Statement.

The state of the art shows various kinds of tables and workstations, including workstations for personal computers.

For an individual who must spend significant amounts of time at a computer workstation, personal comfort and ease of use of equipment are important. The design of certain workstations may cause physical discomfort and even pain for a certain persons. A person may become easily fatigued. These factors may reduce personal productivity and create problems in a work environment. Many jobs today, such as engineering and design jobs, require a person to sit for a substantial number of working hours at a CAD workstation.

Therefore, in an effort to avoid difficulties like those just mentioned, workstations should be designed to be as ergonomically correct as possible, and many known workstations have been designed with that consideration in mind. However, it is believed that further improvements can be made, and the present invention is directed toward a workstation having such improvements. The invention is especially concerned with a CAD workstation where a user sits before a monitor and must utilize a keyboard and other equipment like a computer mouse, a space, or roller, ball, and keypad.

A general aspect of the present invention relates to a computer workstation comprising a platform comprising a generally horizontal support surface large enough to support a monitor and a table disposed frontally of the platform and comprising a flat support surface having a center expanse large enough to support a computer keyboard and wings extending from laterally opposite sides of the center expanse that are themselves sufficiently expansive to support auxiliary computer equipment that requires manual manipulation by a user while allowing a user who is situated frontally of the table and facing a monitor supported on the horizontal support surface of the platform to rest his or her forearms on the wings while manipulating auxiliary equipment supported on the wings. A mechanism operatively relates the table to the platform to allow the table to be positioned in a desired spatial relationship to the platform.

Another general aspect relates to a table and mechanism for use at a computer workstation. The table is adapted to be disposed frontally of a platform that supports a monitor and comprises a flat support surface having a center expanse large enough to support a computer keyboard and wings extending from laterally opposite sides of the center expanse that are themselves sufficiently expansive to support auxiliary computer equipment that requires manual manipulation by a user while allowing a user who is situated frontally of the table and facing the monitor to rest his or her forearms on the wings while manipulating auxiliary equipment supported on the wings. The mechanism operatively relates the table to the platform to allow the table to be positioned in a desired spatial relationship to the platform.

Other general and more specific aspects will been set forth in the ensuing description and claims. More specifically the table may be tilted and/or elevated as desired.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT

Figure 1:
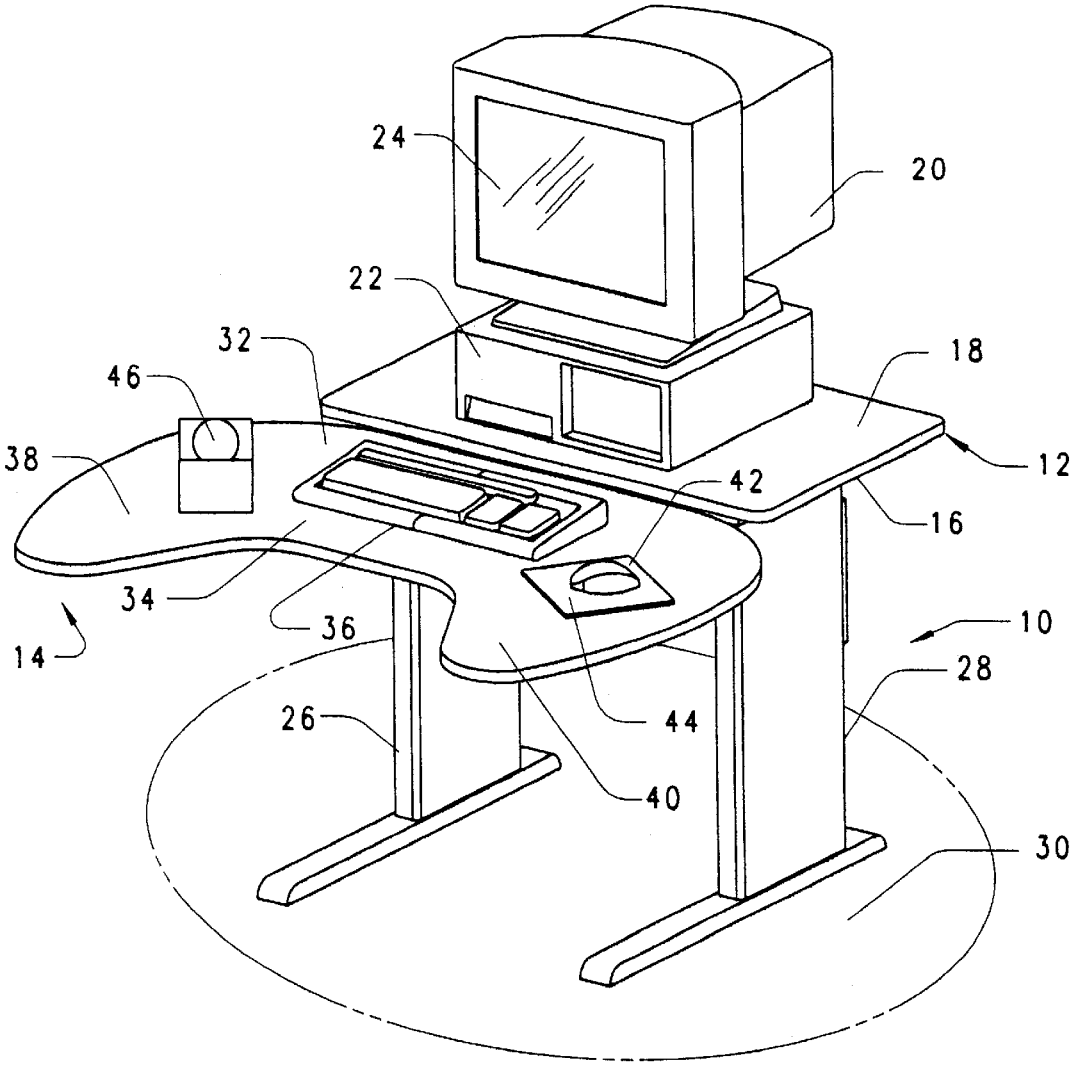
FIG. 1 is a perspective view from the upper right front looking at a workstation that embodies principles of the present invention.

FIGS. 1–4 show the general organization and arrangement of a workstation 10 that embodies principles of the present invention. Workstation 10 comprises a stand 12 and a table 14. Stand 12 comprises a platform 16 that is rectangular in shape and provides a horizontal support surface 18 that is sufficiently large to support at least a computer monitor 20. The drawings show a desktop model computer 22 supported directly on surface 18, with monitor 20 supported on computer 22. Monitor 20 comprises a frontal screen 24 that is viewed by a user of the workstation. Computer 22 has a front face that contains certain manual switches and slots of disk drives that are conveniently accessible by a user. Below screen 24, monitor 20 contains manual switches and controls that are also conveniently accessible by a user. Stand 12 further comprises uprights 26, 28 spaced apart to either lateral side of the stand for stable support of platform 16 at a suitable distance above a floor 30.

Figure 8:
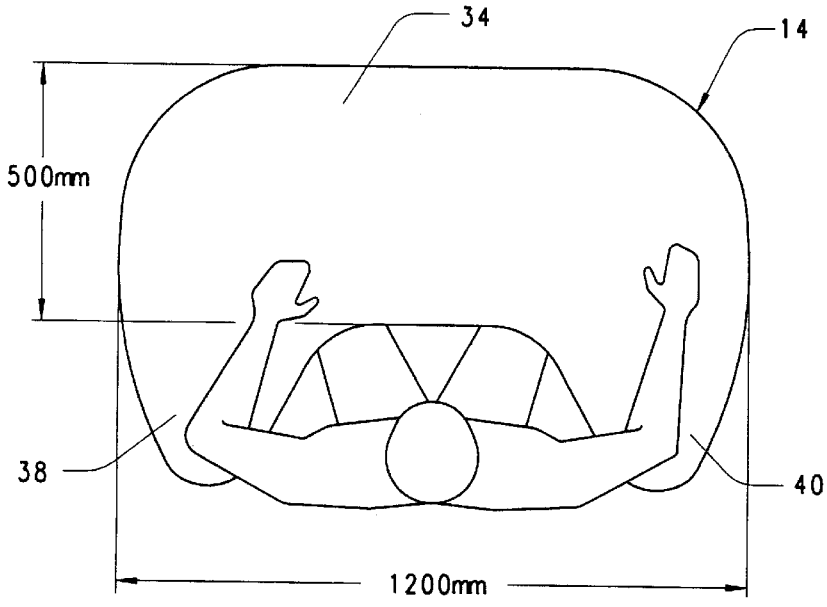
FIG. 8 is top plan view of the portion of the workstation shown in FIG. 6 illustrating a person using the workstation.

Table 14 is disposed frontally of platform 16 and comprises a flat support surface 32. Surface has a shape that provides a center expanse 34 large enough to support a computer keyboard 36 and wings 38, 40 extending from laterally opposite sides of the center expanse 34. Wings 38, 40 are themselves sufficiently expansive to support auxiliary computer equipment that requires manual manipulation by a user while allowing a user who is situated frontally of table 14 and facing monitor screen 24 to rest his or her forearms on the wings while manipulating the auxiliary equipment supported on the wings, as shown by FIG. 8. Examples of auxiliary equipment shown are a computer mouse pad 42, a computer mouse 44, and a space ball 46. Mouse pad 42 is disposed on wing 40, with mouse 44 supported on pad 42. Space ball 46 is supported on wing 38.

Figure 2:
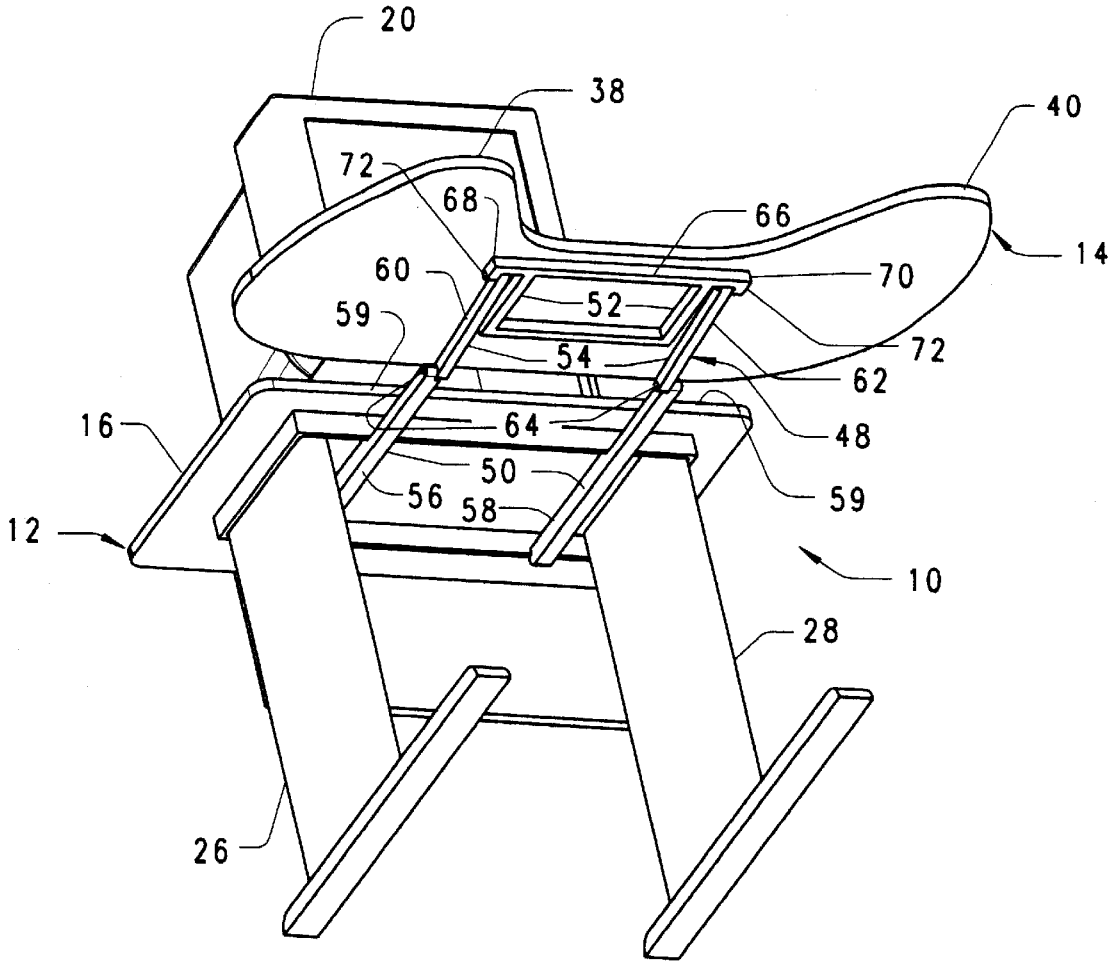
FIG. 2 is a perspective view from the lower left front looking at the workstation.
Figure 3:
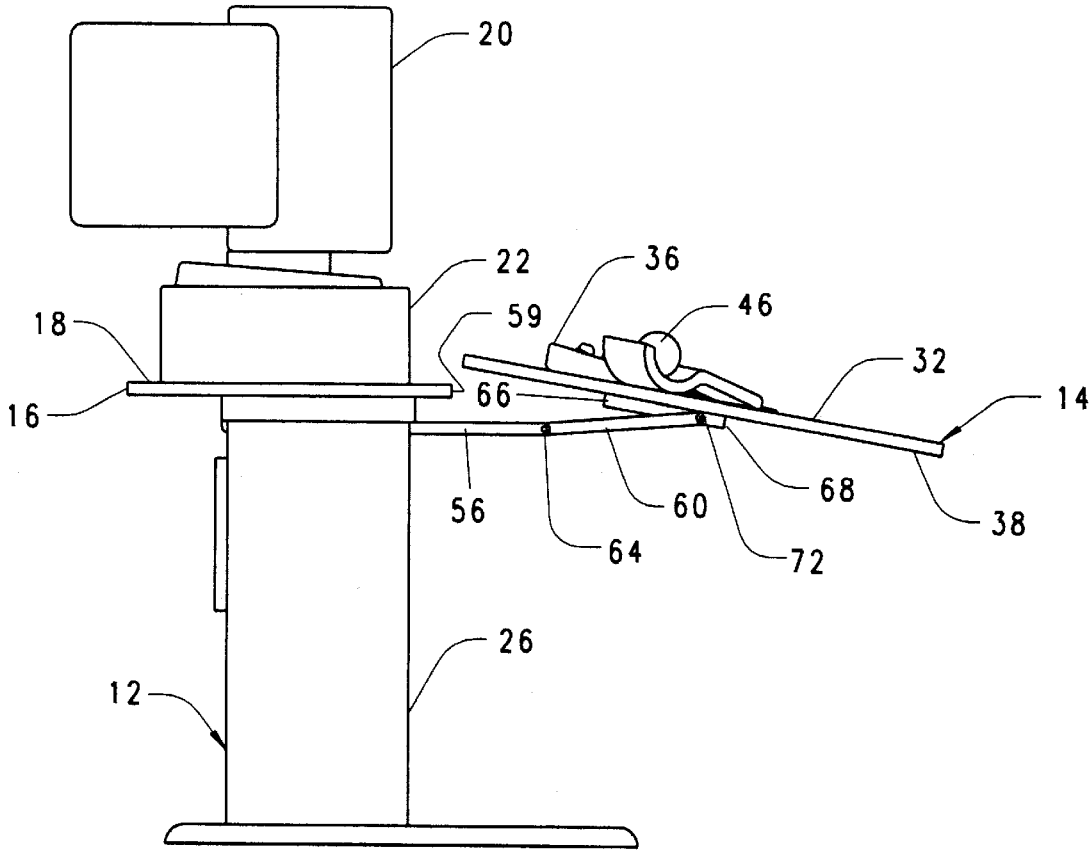
FIG. 3 is a left side elevation view of the workstation.
Figure 4:
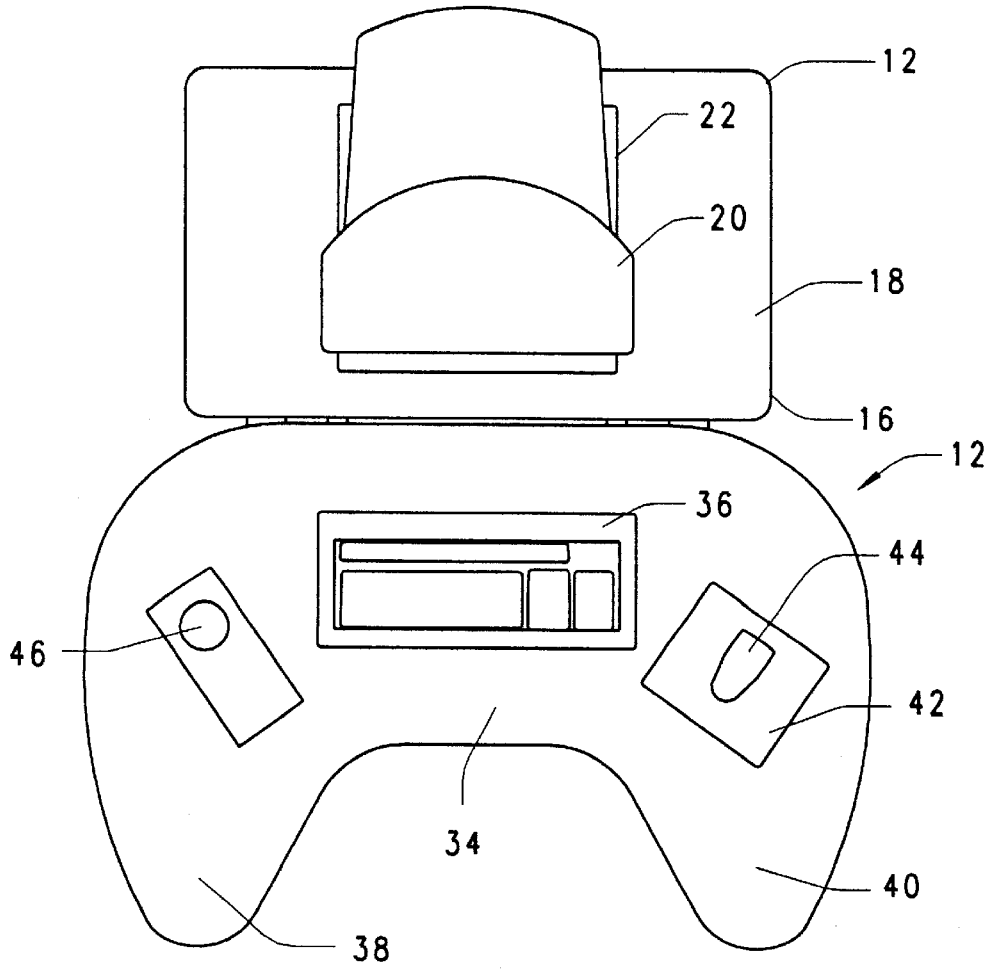
FIG. 4 is a top plan view of the workstation.
Figure 5:
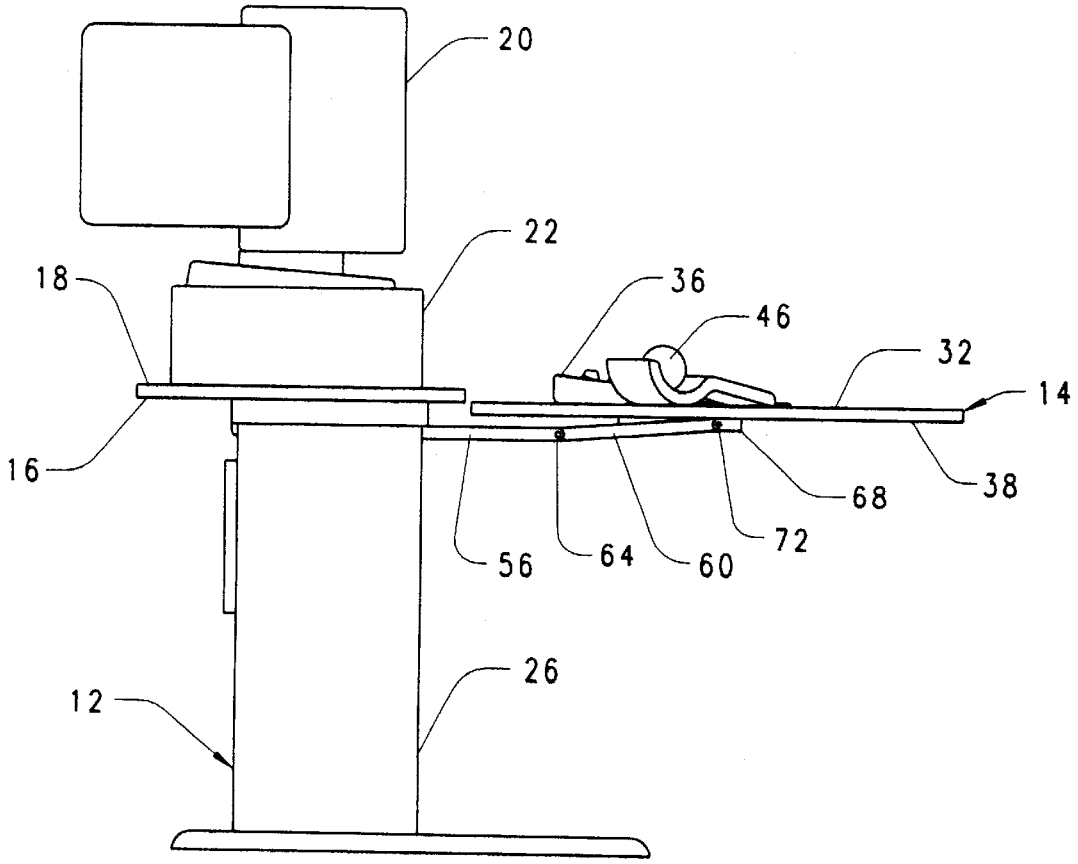
FIG. 5 is view like FIG. 3, but showing a different position of adjustment of the workstation.
Figure 6:
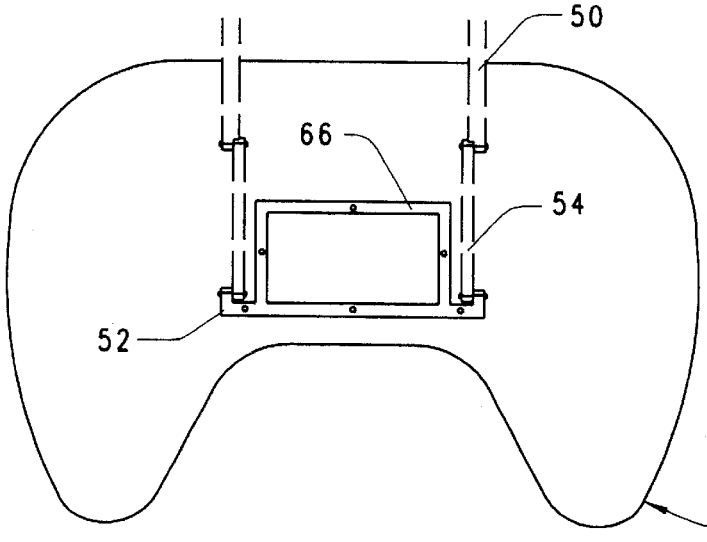
FIG. 6 is a bottom view of a portion of the workstation.
Figure 7:
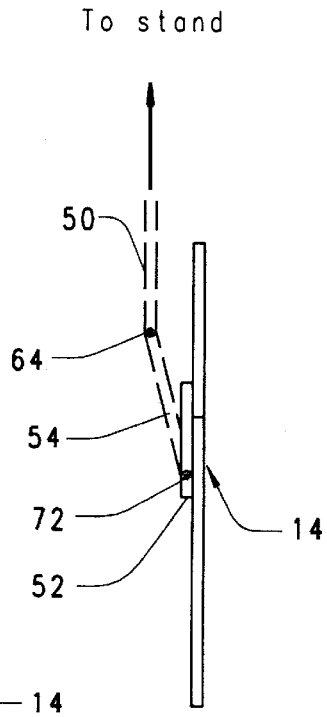
FIG. 7 is a side view of FIG. 6.

All Figures show surface 18 of platform 16 to be horizontal, but FIGS. 1–3 show surface 32 of table 14 to be tilted slightly from horizontal, inclining upward in the direction toward platform 16. FIG. 5 shows surface 32 to be horizontal. That ability to change the inclination of table 14 relative to platform 16 is provided by a metal bracket 48 that appears in FIGS. 2, 3, 5, 6, and 7.

Bracket 48 comprises a fixed portion 50 that attaches to stand 12, a fixed portion 52 that attaches to table 14, and a positionable portion 54 that enables the two fixed portions 50, 52 to be relatively positioned. Fixed portion 50 comprises two parallel bars 56, 58 spaced laterally apart to either side of platform 16 and fastened to the underside of the platform, such as by screws.

Bars 56, 58 extend forward beyond the forward edge 59 of platform 16. At the forward end of each bar 56, 58, a corresponding end of a respective link 60, 62 is pivotally connected to provide for the two links to pivot relative to the bars about a common horizontal axis 64 that is perpendicular to the lengths of the bars and links. The two links 62, 64 form the positionable portion 54 of bracket 48.

Fixed portion 52 comprises a rectangular perimeter frame 66 fastened centrally to the underside of table 14. At two corners of the frame, it also comprises L-shaped bars 68, 70. At the free ends of the L-shaped bars 68, 70, the ends of links 60, 62 that are opposite axis 64 are pivotally connected to provide for the links to pivot relative to fixed portion 52 about a common horizontal axis 72 spaced from, but parallel to, axis 64. Bracket 48 therefore operatively relates table 14 to platform 16 to allow table 14 to be positioned in a desired spatial relationship to platform 16.

An advantage of having two pivot axes 54, 72 is that table 14 can be pivoted relative to links 60, 62, and the links can themselves be pivoted relative to platform 16. Various degrees of table inclination are possible for suiting the needs of various individual users. The elevation of the table can also be set while allowing its support surface to be either horizontal or tilted. With proper dimensioning, the table can even be swung downward to be vertically disposed against the front of uprights 26, 28 for storage.

Figure 9:
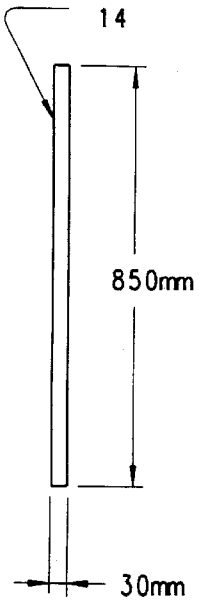
FIG. 9 is a right side view of FIG. 8.

The specific dimensions for table 14 marked on FIGS. 8 and 9 are believed very well suited for most individual users. The table serves to keep the user at a distance from monitor screen 22. FIG. 8 shows a seated user resting forearms on wings 38, 40 while using the equipment on the table. The support provided by the wings and the ability to position the table relative to the platform makes the workstation ergonomically well-suited for most individuals.

In order to maintain a desired position of adjustment, locking devices, such as screw and wings nuts, may be used to lock the pivot joints once a desired adjustment has been obtained. Alternatively, counterbalance mechanisms, such as coil- or gas-springs may be used. Conventional materials, like melamine, may be used to fabricate table 14.

While a presently preferred embodiment has been illustrated and described, it is to be appreciated that the invention may be practiced in various forms within the scope of the following claims.

What is claimed is:

1. A computer workstation comprising:

a platform comprising a generally horizontal support surface large enough to support a monitor;

a table disposed frontally of the platform and comprising a flat support surface having a center expense large enough to support a computer keyboard and wings extending from laterally opposite sides of the center expense that are themselves sufficiently expansive to support auxiliary computer equipment that requires manual manipulation by a user while allowing a user who is situated frontally of the table and facing a monitor supported on the horizontal support surface of the platform to rest his or her forearms on the wings while manipulating the auxiliary equipment supported on the wings; and a mechanism that operatively relates the table to the platform to allow the table to be positioned in a desired spatial relationship to the platform;

wherein the mechanism comprises:

a first pair of laterally spaced apart bars that are fastened directly to the underside of the platform and that extend frontally beyond a frontal edge of the platform;

a second pair of bars each of which is pivotally connected to a respective bar of the first pair for pivoting on the first pair about a common first pivot axis that is frontal of the frontal edge of the platform; and means pivotally attaching the second pair of bars to the underside of the table to provide for the table to pivot on the second pair of bars about a common second pivot axis that is spaced frontal of and parallel to the first pivot axis.

2. A computer workstation as set forth in claim 1 in which the mechanism allows the table to be set both at a desired inclination relative to the platform and to a desired elevation relative to the platform.

3. A computer workstation as set forth in claim 1 in which the platform is part of a stand that comprises uprights supporting the platform above a floor.

4. A computer work station as set forth in claim 1 in which each bar of the second pair is straight.

5. A computer work station as set forth in claim 4 in which each bar of the first pair is straight and disposed flat against the underside of the platform.

6. A computer work station as set forth in claim 4 in which the means pivotally attaching the second pair of bars to the underside of the table to provide for the table to pivot on the second pair of bars about a common second pivot axis that is spaced frontal of and parallel to the first pivot axis comprises a rectangular perimeter frame disposed laterally between the bars of the second pair and attached to the underside of the table, and the second pair of bars are pivotally connected to the rectangular perimeter frame at the second pivot axis.

7. For use at a computer workstation having a platform comprising a generally horizontal support surface large enough to support a monitor:

a table adapted to be disposed frontally of the platform and comprising a flat support surface having a center expense large enough to support a computer keyboard and wings extending from laterally opposite sides of the center expense that are themselves sufficiently expansive to support auxiliary computer equipment that requires manual manipulation by a user while allowing a user who is situated frontally of the table and facing a monitor supported on the horizontal support surface of the platform to rest his or her forearms on the wings while manipulating the auxiliary equipment supported on the wings; and a mechanism for operatively relating the table to the platform to allow the table to be positioned in a desired spatial relationship to the platform;

wherein the mechanism comprises:

a first pair of laterally spaced apart bars that are fastened directly to the underside of the platform and that extend frontally beyond a frontal edge of the platform;

a second pair of bars each of which is pivotally connected to a respective bar of the first pair for pivoting on the first pair about a common first pivot axis that is frontal of the frontal edge of the platform; and means pivotally attaching the second pair of bars to the underside of the table to provide for the table to pivot on the second pair of bars about a common second pivot axis that is spaced frontal of and parallel to the first pivot axis.

8. A table and mechanism as set forth in claim 7 in which the mechanism allows the table to be set both at a desired inclination relative to the platform and to a desired elevation relative to the platform.

9. A table and mechanism as set forth in claim 7 in which each bar of the second pair is straight.

10. A table and mechanism as set forth in claim 9 in which each bar of the first pair is straight.

11. A table and mechanism as set forth in claim 9 in which the means pivotally attaching the second pair of bars to the underside of the table to provide for the table to pivot on the second pair of bars about a common second pivot axis that is spaced frontal of and parallel to the first pivot axis comprises a rectangular perimeter frame disposed laterally between the bars of the second pair and attached to the underside of the table, and the second pair of bars are pivotally connected to the rectangular perimeter frame at the second pivot axis.

* * * * *